US006392502B2

(12) United States Patent
Sweeney et al.

(10) Patent No.: US 6,392,502 B2
(45) **Date of Patent: *May 21, 2002**

(54) BALUN ASSEMBLY WITH RELIABLE COAXIAL CONNECTION

(75) Inventors: Richard Emil Sweeney, Dracut, MA (US); Glen Brian Rochford, Pelham, NH (US)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/213,183

(22) Filed: Dec. 17, 1998

(51) Int. Cl.[7] ..... H01P 5/10
(52) U.S. Cl. ..... 333/26; 333/33
(58) Field of Search ..... 333/26, 33

(56) References Cited

U.S. PATENT DOCUMENTS 3,784,933 A * 1/1974 Scherer et al. ..... 333/26
3,995,239 A * 11/1976 Head et al. ..... 333/26 X
4,123,730 A * 10/1978 Fikart ..... 333/26
4,995,815 A * 2/1991 Buchanan et al. ..... 333/33 X
5,734,355 A * 3/1998 Watanabe ..... 333/25 X

FOREIGN PATENT DOCUMENTS

JP 113501 * 6/1985 ..... 333/33
JP 6188610 * 7/1994 ..... 333/26

OTHER PUBLICATIONS

Motorola; RF Application Reports; Motorola, Inc. 1995; Motorola Semiconductor Application Note; AN1034; Three Balun Designs for Push–Pull Amplifiers, pp. 262–272.

* cited by examiner

*Primary Examiner*—Benny Lee

(57) ABSTRACT

A Balun assembly has a signal conductor (2) on the balanced side of a Balun, the signal conductor (2) being joined to a microstrip RF launch area 7 on a circuit board 6, the signal conductor (2) having a bend of axial orientation for lower cost, reliability, avoiding contact with a ground circuit path (9), being more suited for higher volume manufacturing, that distributes thermal expansion and contraction thereof substantially throughout to lessen stress at a junction of the signal conductor (2) and the RF launch area (7), and the signal conductor (2) being of minimum length and of smooth and even curvature to lessen impedance mismatch at the junction.

5 Claims, 4 Drawing Sheets

BALUN ASSEMBLY WITH RELIABLE COAXIAL CONNECTION

FIELD OF THE INVENTION

The invention relates to a Balun assembly having a coaxial cable and, more particularly to a more reliable, easily manufactured and electrically repeatable Balun assembly. Balun assemblies have a coaxial cable to join with a radio frequency ("RF") launch area on a circuit board.

BACKGROUND OF THE INVENTION

A known Balun assembly is a three port device having one 50 ohm impedance port and two 25 ohm impedance ports. When used on a push-pull RF device with 25 ohm matching structures (two inputs and two outputs), a Balun at the input will be needed as a splitter, splitting the 50 ohms input to two 25 ohm outputs which then feed the RF device. If used at the output of the two 25 ohm matching structures, the Balun is used as a combiner, combining the two 25 ohm inputs into one 50 ohm output).

In the combiner configuration, the unbalanced side of the Balun assembly (the two 25 ohm ports), a coaxial cable ground shield connects one of the 25 ohm ports, by solder joint, to an RF launch area for RF signals. Then that ground shield traverses along a curved ground circuit path on a circuit board to the balanced side, and is connected to ground at the balanced side. That ground shield is continuously soldered to the circuit board trace. Further, a signal conductor of the coaxial cable projects outwardly from the unbalanced side to the second 25 ohm port and joins, by a solder joint, with an RF launch area for RF signals. The same, second 25 ohm RF launch area is connected with a second RF trace of equal electrical length, as the coaxial shield trace and is routed separately to a common, i.e. shared, balanced side ground. The signal conductor of the remainder of the coaxial cable joins, by a solder joint, with the balanced RF launch area for RF signals. The RF launch area is defined by a 50 ohm microstrip circuit trace on the circuit board at the RF output.

The known Balun assembly is provided on both sides of a known bidirectional, push-pull circuit. Both sides of the known push-pull circuit have respective RF inputs, and both sides are coupled by a respective Balun assembly to a single RF output. For example, the respective Balun assembly extracts unbalanced RF input signals from the two 25 ohm inputs characteristic impedance, and provides an RF output signal of 50 Ohms characteristic impedance at the launch area at the RF output. The balanced side and the unbalanced side of the respective Balun assembly have different characteristic impedances. Further, the unbalanced side outer conductor and signal conductor are intended to have RF signals 180 degrees out of phase, due to the conservation of charge. Adjusting their physical dimensions, for example, their dimensional lengths, assures proper match at respective RF signals.

The respective Balun assembly comprises a balanced side having a microstrip transmission line of known construction. A portion of the microstrip transmission line comprises a curved circuit path on a surface of a circuit board of known construction. An unbalanced side of the respective Balun assembly is constructed, in part, as having a coaxial cable, for example, of 50 Ohms characteristic impedance. A shield conductor of the coaxial cable is colinear with a curved ground circuit path on the same surface of the circuit board.

On the circuit board, the curved circuit paths of the balanced and unbalanced sides of a respective Balun assembly are curve back upon themselves, along their lengths to attain compactness in size. Further, the curved circuit paths of the respective Balun assembly are symmetrical. Therein lies a problem. The curved circuit paths are shaped primarily to attain their symmetry and compactness in size. However, the curved ground circuit path constrains the coaxial cable to extend along the curved circuit path, and the exposed signal conductor of the coaxial cable is exposed at length from the shield conductor, which contributes to undesired impedance mismatch. Further, the exposed signal conductor must be shaped by bending to fit with the geometry of the Balun assembly on the circuit board. For example, the exposed signal conductor is shaped by bending to extend toward, and to join with, the RF launch area.

Because the exposed signal conductor must be shaped to fit the geometry of the Balun assembly, and be bent and joined to a perpendicular RF launch. A sharp bend of less than minimum radii is normally incorporated. The expanding dielectric over temperature cycles pushes on the exposed bent section, which contributes unduly to stress concentration of the signal conductor at the Balun assembly. Stress concentration in the signal conductor leads to undesired fracture of a solder joint between the signal conductor and the RF launch area, as the Balun assembly is exposed to changing environmental temperatures over the passage of time.

Further, because the exposed signal conductor must be shaped to fit the geometry of the Balun assembly, a bent and lengthy signal conductor results, which contributes unduly to impedance mismatch. For example, the exposed signal conductor contributes to impedance mismatch, for which impedance compensation is required to rectify undesired voltage standard wave reflection ("VSWR") due to the severity of the impedance mismatch. The exposed length and unevenness of bend of the exposed signal conductor contributes to the severity of impedance mismatch, and increases the difficulty in providing the required impedance compensation.

Prior to the invention, fabrication of the known Balun assembly required shaping of the coaxial cable to fit with undesirable, predetermined locations of both the ground circuit path and the RF launch area on the circuit board, which contributed undue mechanical stress and undesired impedance mismatch at a junction of the coaxial cable and the RF launch area.

SUMMARY OF THE INVENTION

According to the invention, a Balun assembly has a coaxial cable that has a precise electrical length, an exposed signal conductor of the coaxial cable is of minimum length and of smooth and even curvature, by way of substantially straight portions of minimum length adjoining a portion of substantially smooth and even curvature and of minimum length, the signal conductor distributes thermal expansion and contraction thereof substantially throughout the portions of minimum length and the portion of substantially smooth and even curvature, and the signal conductor of minimum length and of smooth and even curvature lessens impedance mismatch.

An advantage of the invention resides in providing a Balun assembly of improved reliability and construction, and lessened VSWR.

A further advantage of the invention resides in a method of making a Balun assembly having an exposed signal conductor that contributes to lessened impedance mismatch, and distributes thermal expansion and contraction thereal-ong to reduce stress concentration.

Further, according to the invention, a method of making a Balun assembly comprises the steps of, sizing a coaxial cable to a precise electrical length, shaping an exposed signal conductor that projects from the coaxial cable with a portion of substantially smooth and even curvature and of minimum length, to project an end of the signal conductor substantially straight toward an RF launch area defined by a microstrip area on a circuit board, and positioning the RF launch area on the circuit board so as to be directly opposite the remainder of the cable and in close proximity thereto to minimize the length of the exposed signal conductor, thereby contributing to lessened impedance mismatch, and thereby distributing thermal expansion and contraction along the portion of substantially smooth and even curvature to reduce strain on the joint.

A further advantage of the invention resides in a method of making a Balun assembly having an exposed signal conductor that contributes to lessened impedance mismatch, and that distributes thermal expansion and contraction therealong to reduce stress concentration.

BRIEF DESCRIPTION OF THE DRAWINGS

An embodiment of the invention will now be described by way of example with reference to the accompanying drawings, according to which.

DETAILED DESCRIPTION THE INVENTION

Figure 1:
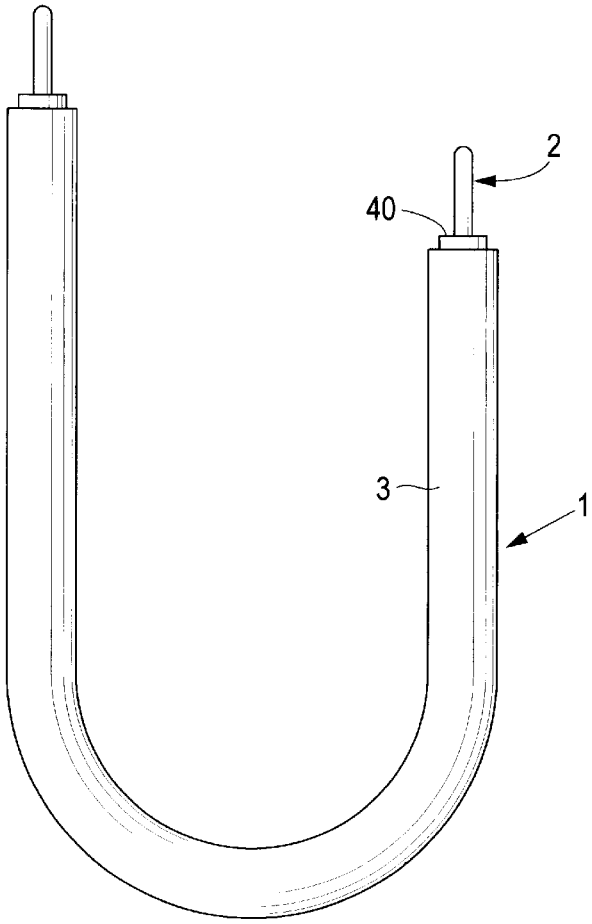
FIG. 1 is a top view of a coaxial cable of precise electrical length, with an exposed signal conductor of the coaxial cable projecting from the coaxial cable, the signal conductor having a distinctive shape.

With reference to FIG. 1, a coaxial cable 1 has an axial signal conductor 2 and a concentric ground shield 3. A concentric dielectric material 40 is disposed between the signal conductor 2 and the ground shield 3. The coaxial cable 1 has a known characteristic impedance, for example, 50 Ohms characteristic impedance. The coaxial cable 1 is a part of a Balun assembly 4 that is shown, in part, in FIG. 4. For the purpose of describing the invention, only portions of the Balun assembly 4 are disclosed. Accordingly, with reference to FIGS. 4 and 5, a balanced side of the Balun assembly 4 has a curved microstrip transmission line 5 on a circuit board 6 connected to an RF launch area 7 at an RF output 8 (see FIG. 4) that is shown as a microstrip circuit path. The RF launch area 7 is defined by a microstrip area on the circuit board 6.

Figure 4:
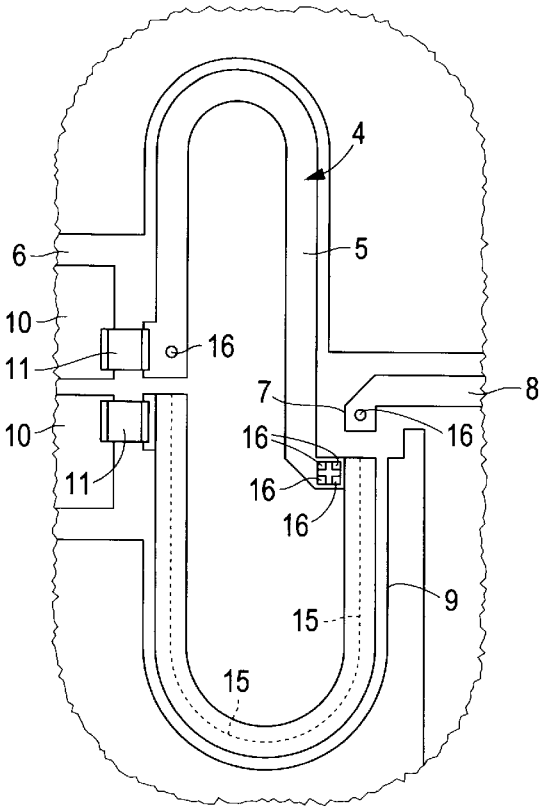
FIG. 4 is a fragmentary top view of a circuit board and a portion of a Balun assembly having a desired geometry.
Figure 5:
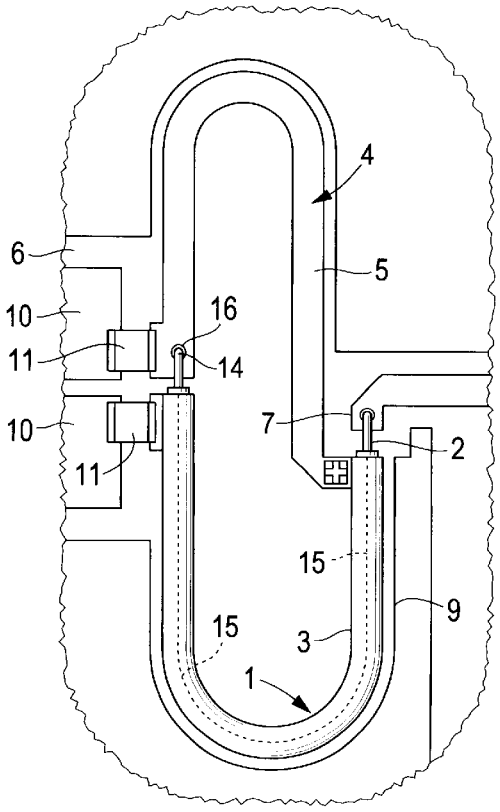
FIG. 5 is a fragmentary top view of the structure, as shown in FIG. 4, together with the coaxial cable, as shown in FIG. 1.

An unbalanced side of the Balun assembly 4 includes a curved ground circuit path 9 on the circuit board 6 to which the ground shield 3 of the coaxial cable 1 is to be joined, as shown in FIG. 5. As shown in FIGS. 4 and 5, two RF inputs 10 are defined by microstrip areas on the circuit board 6. The two RF inputs 10 are coupled to the Balun assembly 4 by respective DC blocking capacitors 11.

Figure 7:
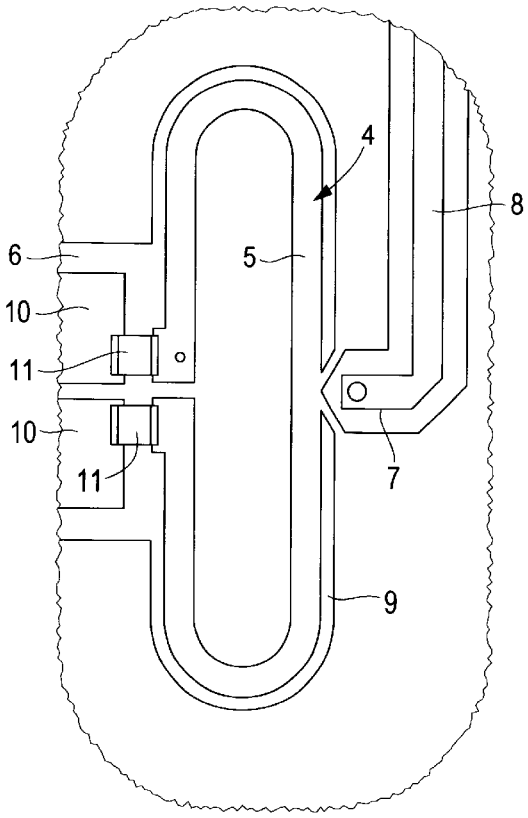
FIG. 7 is a fragmentary top view of circuit board and a portion of a Balun assembly having an undesired geometry.
Figure 8:
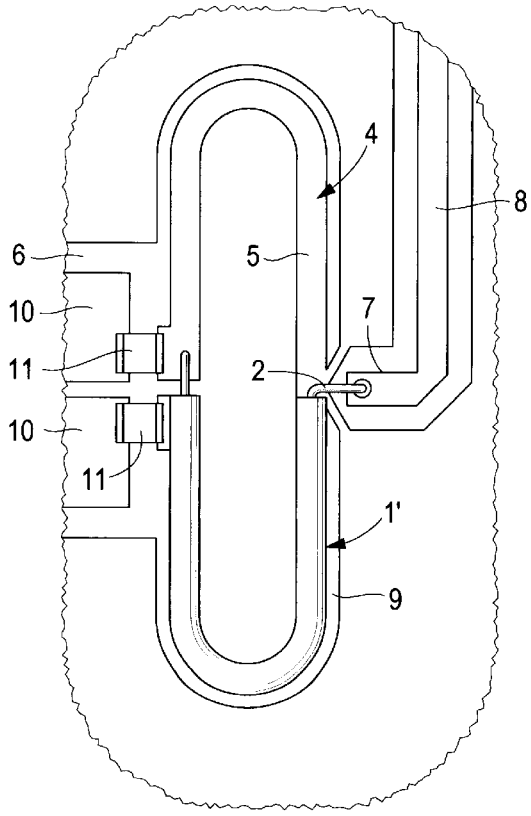
FIG. 8 is a fragmentary top view of the structure, as shown in FIG. 7, together with a coaxial cable of undesired geometry.

With reference to FIGS. 7 and 8, a Balun assembly 4 of different geometry is shown. In FIG. 7, the microstrip transmission line 5 of the respective Balun assembly 4 is curved back upon itself, along its length to attain compactness in size. Further, the ground circuit path 9 of the Balun assembly 4 is curved to attain compactness in size and to attain symmetry with the microstrip transmission line 5. Like the inventive arrangement depicted in FIGS. 4 and 5, the structure of FIGS. 7 and 8 includes dual RF input ports 10, defined by microstrip areas on a circuit board 6, which are coupled to the Balun assembly 4 by respective DC blocking capacitors 11.

With reference to FIG. 8, another coaxial cable 1', similar to the coaxial cable 1, as shown in FIG. 5, is fabricated to a desired physical length that will transmit RF signals, and that will launch such RF signals of a desired phase, or desired phase angle, at the rf launch area 7 having a geometry, as shown in FIGS. 7 and 8, that differs from the geometry as shown in FIGS. 4 and 5. The RF launch area 7 is disposed at an RF output 8 that is shown in FIGS. 7 and 8 as a microstrip circuit path. The coaxial cable 1' is then shaped to fit with the geometry of the Balun assembly 4 on the circuit board 6 that is shown in FIGS. 7 and 8. Thereby, the coaxial cable 1' is constrained to extend along the symmetrical curve of the ground circuit path 9. Further the exposed signal conductor 2 is bent to extend to the RF launch area 7. It has been observed that the curved ground circuit path 9 of FIGS. 7 and 8, and the RF launch area 7 has an undesirable geometry. The undesirable geometry results in the following disadvantages:

A. The exposed signal conductor 2 of the coaxial cable 1' is exposed at length from the coaxial cable 1', which contributes to undesired impedance mismatch. To maintain minimum bend radii of the center conductor and launch to the trace 7, the length is reflective to RF signals as shown in FIG. 8.

B. Physical connection "shorting-out" between the signal conductor 2 and the shielding is a common manufacturing problem.

C. Further, the exposed signal conductor 2 must be shaped by bending to a dual axis bend to fit with the undesirable geometry of the Balun assembly 4 on the circuit board 6. It is cost prohibitive, both, to make the dual two axis bend, and to preserve that bend during the various steps of the manufacturing process preceding actual installation. For example, the concentric shield of the coaxial cable 1' is bent to follow along the curved ground circuit path 9 of the Balun assembly 4. The exposed signal conductor 2 of the coaxial cable 1' is fabricated by bending, to extend toward, and to join with, the RF launch area 7 by way of a solder joint.

With continuing reference to FIGS. 7 and 8, an unbalanced condition of the Balun assembly will now be described. The exposed signal conductor 2 (see FIG. 8) emerges from the shield of the coaxial cable, and extends over the ground circuit path 9, and is curved to one side of the ground circuit path 9. Because the shield on the coaxial cable is shortened relative to the exposed signal conductor 2, an offset is created, which makes the two legs of the Balun assembly unbalanced, e.g., ground currents of the ground circuit path 9 are influenced by the offset.

This part of the exposed signal conductor 2 has a minimum length of $\pi D/4$, where D is the overall diameter of the coaxial cable. Further, the exposed signal conductor 2 spans a gap between the RF launch area 7 and one side of the ground circuit path 9 of the Balun assembly 4. The standard practice is to dimension the gap the same, more or less, to the line width of the RF launch area 7, although reducing the gap size is better. The signal conductor 2, after extending across the gap, further extends a distance to the junction with the launch area, for example, a distance of ½ the line width, according to standard practice. The length of the exposed signal conductor 2 extends in multiple planes, and the overall length and shape are uncertain, and difficult to repeat and maintain in a manufacturing environment.

Because the exposed signal conductor 2 must be shaped to fit the geometry of the ground circuit path 9 and the RF launch area 7, abrupt and uneven bends are shaped in the signal conductor 2, which create locations for stress concentration in the signal conductor 2, during thermal expansion and contraction of the signal conductor 2, as the known Balun assembly 4 is exposed to changing environmental temperatures. Exposure to environmental temperatures over time will cause undesired fracture of a solder joint between the signal conductor 2 and the RF launch area 7.

Further, the exposed signal conductor 2 comprises an unshielded signal transmission line that has characteristic impedance that differs significantly from the desired characteristic impedance of the coaxial cable 1'. The exposed signal conductor 2 contributes to impedance mismatch, for which impedance compensation is required to rectify undesired VSWR. The exposed length and unevenness of bend of the exposed signal conductor 2 contributes to impedance mismatch, and increases the difficulty in providing the required impedance compensation.

Prior to the invention, the Balun assembly 4 of undesirable geometry, as shown in FIGS. 7 and 8, required a process to be performed, of shaping of the coaxial cable 11 to fit with predetermined locations of both the ground circuit path 9 and the RF launch area 7 on the circuit board 6, which contributed to undue mechanical stress and undesired impedance mismatch at the juncture of the coaxial cable 1' and the RF launch area 7. These disadvantages are overcome by the invention.

Figure 6:
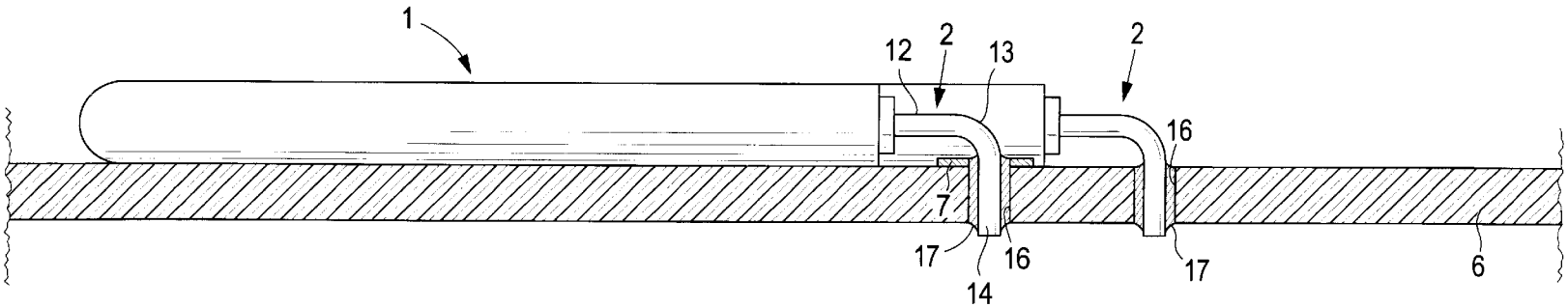
FIG. 6 is a fragmentary side view of the structure, as shown in FIG. 4.

With reference to FIG. 1, a coaxial cable 1 to join with an RF launch area 7 on a circuit board 6, as shown in FIG. 5, will be described. The coaxial cable 1 is fabricated to a desired physical length that will transmit and launch RF signals of a desired phase, or phase angle. Further, a signal conductor 2 of the coaxial cable 1 projects outwardly from the coaxial cable 1, and joins, by a solder joint 17 with an RF launch area 7, as shown in FIG. 6.

Figure 2:
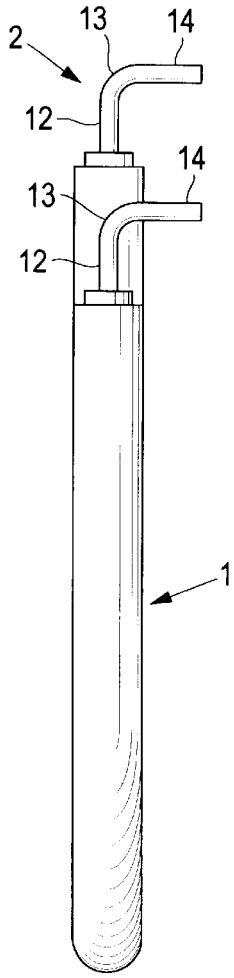
FIG. 2 is a side view of the coaxial cable, as shown in FIG. 1.
Figure 3:
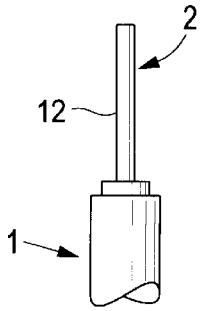
FIG. 3 is a fragmentary side view of an exposed signal conductor prior to shaping the exposed signal conductor to its distinctive shape, as shown in FIG. 1.

Further described with reference to FIG. 1, is a method of making the Balun assembly 4 as shown in FIGS. 4 and 5. A method of making the Balun assembly comprises the steps of, shaping an exposed signal conductor 2 that projects from the coaxial cable 1 to extend a substantially smoothly and evenly straight portion 12 along a straight line that is coplanar with an axis of the cable 1, as shown in FIG. 3, and shaping an end portion 13 of the signal conductor 2 to extend substantially smoothly and evenly curved along a plane substantially perpendicular to the axis of the cable 1, as shown in FIG. 2, so as to extend a straight end 14 of the signal conductor 2 substantially perpendicular to the straight line, as shown in FIG. 2, and substantially straight toward the circuit board 6. The length of the exposed signal conductor 2 need not exceed $\pi D/4$, where D is the overall diameter of the coaxial cable 1. Further, the signal conductor 2 extends in a single plane, as contrasted to the dual plane bend of the undesired geometry, discussed with reference to FIGS. 7 and 8. Further, an imbalance of the two legs of the Balun assembly is avoided, by having the shield of the coaxial cable extending fully with the signal conductor 2 along the ground circuit path 9.

As best seen in FIG. 2, this process provides a signal conductor 2 of minimum length and free of abrupt bends, which contributes lessened impedance mismatch and distributed thermal expansion and contraction of the exposed signal conductor 2 substantially along the substantially straight portions 12, 14 and along the smoothly and evenly curved end portion 13 to lessen stress concentration at the joint 17 (FIG. 6) between the signal conductor 2 and the RF launch area 7. Thus, the signal conductor 2 has the desired shape, as shown in FIG. 2. It is noted that the signal conductor 2 is formed with similar shapes at opposite ends thereof.

The coaxial cable 1 that has the signal conductor 2 of desired shape, as shown in FIG. 2, would be unable to fit the geometry of the Balun assembly 4 as shown in FIG. 7. As before described, shaping the coaxial cable 1' to fit the undesirable geometry of the circuit as shown in FIG. 7, results in disadvantages. These disadvantages are avoided by the invention, as described with reference to FIGS. 4, 5 and 6.

With reference to FIG. 5, a desirable geometry of the Balun assembly 4 is provided by a method step of positioning the RF launch area 7 on the circuit board 6 to intercept and underlie the end 14 of the signal conductor 2 of the coaxial cable 1, as shown in FIG. 2. The exposed signal conductor 2 projects substantially straight from the cable 1, as shown in FIG. 3, which projects the center conductor to a position that overlies the RF launch area 7.

With reference to FIG. 5, the RF launch area 7 is positioned on the circuit board 6 in axial alignment with the coaxial cable 1. Further, with reference to FIG. 5, the RF launch area 7 is positioned directly opposite the cable 1 and in close proximity thereto to minimized the length of the exposed signal conductor 2, thereby contributing to lessened impedance mismatch, and thereby distributing thermal expansion and contraction along the substantially straight portions 12, 14 and along the portion of substantially smooth and even curvature to reduce strain on the joint 17.

Further with reference to FIG. 4, will continue to be described. The ground circuit path 9 is provided by a method step of positioning the ground circuit path 9 of the circuit board 6 along a curved path 15, as shown by an imaginary, dotted line in FIG. 4. The coaxial cable 1, as shown in FIG. 1, is formed with a smooth and even curvature to extend along the curved path 15. The length and shape of the ground circuit path 9, according to a desirable geometry, as shown in FIG. 4, conforms to the precise electrical length of the coaxial cable 1 that is described with reference to FIG. 1. Thereby, the curved path 15 of the ground circuit path 9, shown in FIG. 4, disregards a need for physical symmetry (still needs electrical length symmetry) with the curved microstrip transmission line 5, as shown in FIGS. 4 and 5. The method of making the Balun assembly 4 further comprises, the step of positioning the RF launch area 7 in axial alignment with the curved path 15 of the ground circuit path 9, and further, the step of positioning the RF launch area 7 directly opposite, and in close proximity to an end of the ground circuit path 9. Thereby, the length of the exposed signal conductor 2 is reduced to a minimum to lessen undesired VSWR and to limit the length that is subject to thermal expansion and contraction.

As exemplified by FIGS. 2 and 6, a Balun assembly 4 according to the invention has a coaxial cable 1 that is provided with a precise electrical length, a portion 12 of an exposed signal conductor 2 of the coaxial cable 1 projects from the coaxial cable 1 and substantially evenly along a straight line that is coplanar with an axis of the cable 1, and an end part 13 of the signal conductor 2 is substantially smoothly and evenly curved along a plane substantially perpendicular to the straight line and substantially straight toward an RD launch area 7 defined by a microstrip area on a circuit board 6, whereby impedance mismatch is substantially reduced, and whereby the signal conductor 2 distributes thermal expansion and contraction along its substantially straight parts and along the smoothly and evenly curved end part of minimum length, to reduce strain on the joint 17.

With reference to FIGS. 5 and 6, the coaxial cable is shaped to extend along a curved path 15 in a flat plane, the RF launch area 7 is in axial alignment with the curved path 15, the end 14 (FIG. 6) of the signal conductor 2 overlies the FR launch area 7 and is joined thereto by a solder joint 17. For example, the end 14 of the signal conductor 2 projects through a via 16 (FIG. 6). The via 16 is an opening through the circuit board 6 that is lined with metal plating. The end 14 of the signal conductor 2 is joined by a solder joint 17 to the metal plating.

As shown in FIGS. 5 and 6, the opposite end 14 of the signal conductor 2 is joined by a solder joint 17 to a similar via 16 that extends through the microstrip transmission line 5. The shield conductor of the coaxial cable 1 is joined by a solder joint 11, FIG. 6, to the curved ground circuit path 9. With reference to FIG. 4, a group of four vias 16 connect the ground circuit path 9 through the circuit board 6, and to an opposite side of the circuit board 6.

The RF launch area 7 is positioned on the circuit board 6 so as to be directly opposite the cable 1 and in close proximity thereto to minimize the length of the exposed signal conductor 2.

Accordingly, as part of a Balun assembly 4, a coaxial cable 1 has a precise electrical length, a signal conductor 2 projects outwardly from the coaxial cable 1 and substantially evenly along a straight line that is coplanar with an axis of the cable 1, an end part of the signal conductor 2 is substantially smoothly and evenly curved to extend an end 14 of the signal conductor 2 substantially perpendicular to the straight line, a ground circuit path 9 on a circuit board 6 is provided along a curved path 15 to be joined to a ground shield 3 of the coaxial cable 1, an RF launch area 7 defined by a microstrip area on the circuit board 6 is positioned in axial alignment with the curved path 15 and directly opposite an end 14 of the ground circuit path 9, the coaxial cable 1 is shaped with a smooth and even curvature to extend along the curved path 15, and the end 14 of the signal conductor 2 intercepts the RF launch area 7 and is joined thereto by a solder joint 17, whereby thermal expansion and contraction of the signal conductor 2 along the straight line and along the smoothly and evenly curved end part reduces strain on the joint 11 and lessens impedance mismatch for which impedance compensation would be required.

At the balanced end, the signal conductor 2 that is bent at the axial orientation is lower cost, as compared to a complex bend, provides a reliable connection that will not contact the ground circuit conductor and is more suited for higher volume manufacturing. The signal conductor distributes thermal expansion and contraction thereof substantially throughout the portion of substantially smooth and even curvature, and the signal conductor of minimum length and of smooth and even curvature lessens impedance mismatch at a junction of the signal conductor and the RF launch area.

The common bends 13 (FIG. 2) at both ends of the signal conductor 2 make for a reduced cable cost. Assembly and installation time is reduced, which increases manufacturing volumes, and the possibility of the signal conductor bends contacting the ground circuit conductor is eliminated.

Other embodiments and modifications of the invention are intended to be covered by the spirit and scope of the appended claims.

What is claimed is:

1. A Balun assembly comprising:

a first side including a microstrip transmission line disposed on a circuit board, said microstrip transmission line defining a first circuit path having first and second rectilinear portions and a curved portion disposed therebetween; and a second side including a coaxial cable of precise electrical length, said coaxial cable defining a second circuit path having first and second rectilinear portions and a curved portion disposed therebetween, a first end of said coaxial cable having an exposed signal conductor characterized by a single bend for connection to an underlying RF launch area coaxially aligned with the second rectilinear portion of said second circuit path;

wherein the first rectilinear portion of said first circuit path is coaxially aligned with the first rectilinear portion of said second circuit path; and wherein the second rectilinear portion of said first circuit path is axially offset from the second rectilinear portion of said second circuit path, whereby the exposed signal conductor at said first end of the coaxial cable is electrically coupled to said underlying RF launch area, whereby said first and second circuit paths are electrically symmetrical but physically asymmetrical.

2. The Balun assembly of claim 1, wherein said second side further includes a curved ground path electrically coupled to a ground shield of the coaxial cable.

3. The Balun assembly of claim 1, further including microstrip sections defining first and second input ports, respectively, said first and second input ports being capacitively coupled to a corresponding one of said first and second circuit paths.

4. The Balun assembly of claim 1, wherein the bend of said first end of said coaxial cable is characterized by a smooth and even curvature dimensioned and arranged to uniformly distribute thermal expansion and contraction.

5. The Balun assembly of claim 1, wherein a second end of said coaxial cable includes an exposed signal conductor characterized by a single bend electrically coupled to an underlying portion of said first rectilinear portion of said first circuit path.

* * * * *